US011749420B2

(12) United States Patent
Bars

(10) Patent No.: US 11,749,420 B2
(45) Date of Patent: Sep. 5, 2023

(54) CONTAINERS FOR A SMALL VOLUME OF LIQUID TARGET MATERIAL FOR IRRADIATION IN A CYCLOTRON

(71) Applicant: Dana-Farber Cancer Institute, Inc., Boston, MA (US)

(72) Inventor: Erol Bars, Exeter, NH (US)

(73) Assignee: Dana-Farber Cancer Institute, Inc., Boston, MA (US)

( * ) Notice: Subject to any disclaimer, the term of this patent is extended or adjusted under 35 U.S.C. 154(b) by 169 days.

(21) Appl. No.: 17/284,329

(22) PCT Filed: Oct. 11, 2019

(86) PCT No.: PCT/US2019/055773
§ 371 (c)(1),
(2) Date: Apr. 9, 2021

(87) PCT Pub. No.: WO2020/077171
PCT Pub. Date: Apr. 16, 2020

(65) Prior Publication Data

US 2021/0327600 A1 Oct. 21, 2021

Related U.S. Application Data

(60) Provisional application No. 62/744,448, filed on Oct. 11, 2018.

(51) Int. Cl.
*G21G 1/10* (2006.01)
*G21K 5/08* (2006.01)
*H05H 6/00* (2006.01)

(52) U.S. Cl.
CPC ..... *G21K 5/08* (2013.01); *G21G 1/10* (2013.01); *H05H 6/00* (2013.01)

(58) Field of Classification Search
CPC ..... G21G 1/10; G21K 5/08
See application file for complete search history.

(56) References Cited

U.S. PATENT DOCUMENTS 5,416,440 A 5/1995 Lyons et al.
6,586,747 B1 * 7/2003 Erdman ..... H05H 6/00 376/195

(Continued)

FOREIGN PATENT DOCUMENTS

JP 2008/071766 A 3/2008
JP 2013/246131 A 12/2013
WO WO-2020/077171 A1 4/2020

OTHER PUBLICATIONS

International Search Report and Written Opinion for International Application No. PCT/US2019/055773 dated Dec. 19, 2019.

(Continued)

*Primary Examiner* — Sharon M Davis
(74) *Attorney, Agent, or Firm* — Dana-Farber Cancer Institute, Inc.

(57) ABSTRACT

Devices, systems, and methods for efficiently preparing and containing a small volume of liquid target material for irradiation by a cyclotron are provided. In various embodiments, a device includes a housing having a chamber and the housing has a top surface that is substantially flat. The chamber has a substantially flat base and a wall having a first portion extending from the base with a first radius of curvature and a second portion extending from the first portion having a second radius of curvature that is less than the first radius. The chamber also includes an inlet aperture, an outlet aperture, and a lip having a second surface that is substantially flat and recessed from the first surface. In various embodiments, the device includes a heat sink including a plurality of parallel fins disposed around the chamber.

18 Claims, 8 Drawing Sheets

(56) References Cited

U.S. PATENT DOCUMENTS

| | | | | |
|---|---|---|---|---|
| 2010/0086095 | A1 | 4/2010 | Ogasawara et al. | |
| 2010/0278293 | A1 | 11/2010 | Stokely et al. | |
| 2013/0163708 | A1 | 6/2013 | Lambert et al. | |
| 2016/0141062 | A1 | 5/2016 | Zhang et al. | |
| 2017/0221594 | A1 | 8/2017 | DeGrado et al. | |
| 2019/0080813 | A1* | 3/2019 | Smith | G21G 1/12 |

OTHER PUBLICATIONS

Extended European Search Report for EP Application No. 19872225.8 dated May 27, 2022.

* cited by examiner

CONTAINERS FOR A SMALL VOLUME OF LIQUID TARGET MATERIAL FOR IRRADIATION IN A CYCLOTRON

CROSS-REFERENCE TO RELATED APPLICATIONS

This application is the U.S. national phase of International Patent Application No. PCT/US19/55773, filed on Oct. 11, 2019, which claims the benefit of priority to U.S. Provisional Application No. 62/744,448, filed on Oct. 11, 2018; the entire contents of each of said applications are hereby incorporated by reference in their entirety.

BACKGROUND

Embodiments of the present disclosure relate to containers for a small volume of liquid irradiation target material and methods of preparing and containing a small volume of liquid target material for irradiation by a cyclotron.

BRIEF SUMMARY

According to embodiments of the present disclosure, devices for, systems for, and methods of preparing a liquid target material for irradiation are provided. In various embodiments, a device for containing a liquid irradiation target material includes a housing having a chamber and a first surface that is substantially flat. The chamber has a substantially flat base and a wall including a first portion extending from the base and a second portion extending from the first portion. The first portion has a first radius of curvature and the second portion has a second radius of curvature that is less than the first radius. The chamber further includes an inlet aperture, an outlet aperture, and a lip having a second surface that is substantially flat and recessed from the first surface. The device further includes a heat sink comprising a plurality of fins disposed around the chamber.

In various embodiments, the first radius of curvature is between approximately 2 mm to approximately 3 mm. In various embodiments, the second radius of curvature is between approximately 0.2 mm to approximately 1 mm. In various embodiments, the chamber has a depth of approximately 7.3 mm. In various embodiments, the chamber has a volume of approximately 0.5 mL to 2 approximately 0.5 mL. In various embodiments, the chamber has a volume of approximately 0.7 mL to approximately 1.0 mL.

In various embodiments, the plurality of fins comprises parallel plates. In various embodiments, the housing includes a metal of Niobium or Aluminum. In various embodiments, the metal is selected from group 6 of the periodic table in various embodiments, the device is made by 3D printing or CNC machining. In various embodiments, the housing comprises a cylindrical shape.

In various embodiments, the device includes a gasket disposed on the second surface. In various embodiments, the gasket is a metal. In various embodiments, the metal includes Havar alloy, aluminum and/or combinations thereof. In various embodiments, the device includes a front flange, a rear flange, and a cooling flange. In various embodiments, the front flange is adapted to connect to a cyclotron.

In various embodiments, a method of preparing a liquid target material for irradiation includes providing a device for containing a small volume irradiation target material. In various embodiments, the device includes a housing having a chamber and the housing has a top surface that is substantially flat. The chamber has a substantially flat base and a wall having a first portion extending from the base with a first radius of curvature and a second portion extending from the first portion having a second radius of curvature that is less than the first radius. The chamber also includes an inlet aperture, an outlet aperture, and an opening defining a lip having a second surface that is substantially flat and recessed from the first surface. In various embodiments, the device includes a heat sink including a plurality of parallel fins disposed around the chamber. A gasket is inserted in the lip of the device. The gasket is contacted with a foil thereby fluidly sealing the chamber. The liquid target material is loaded into the chamber of the device.

DETAILED DESCRIPTION

The present disclosure is directed towards a radioisotope production system that receives the output from a cyclotron, which is a type of particle accelerator in which a beam of charged particles (e.g., H− charged particles or D− charged particles) are accelerated outwardly along a spiral orbit. The cyclotron directs the beam into a target material to generate the radioisotopes (or radionuclides). Cyclotrons are known in the art, and an exemplary cyclotron is disclosed in U.S. Pat. No. 10,123,406, the entirety, including structural components and operational controls, is hereby incorporated by reference.

Figure 1:
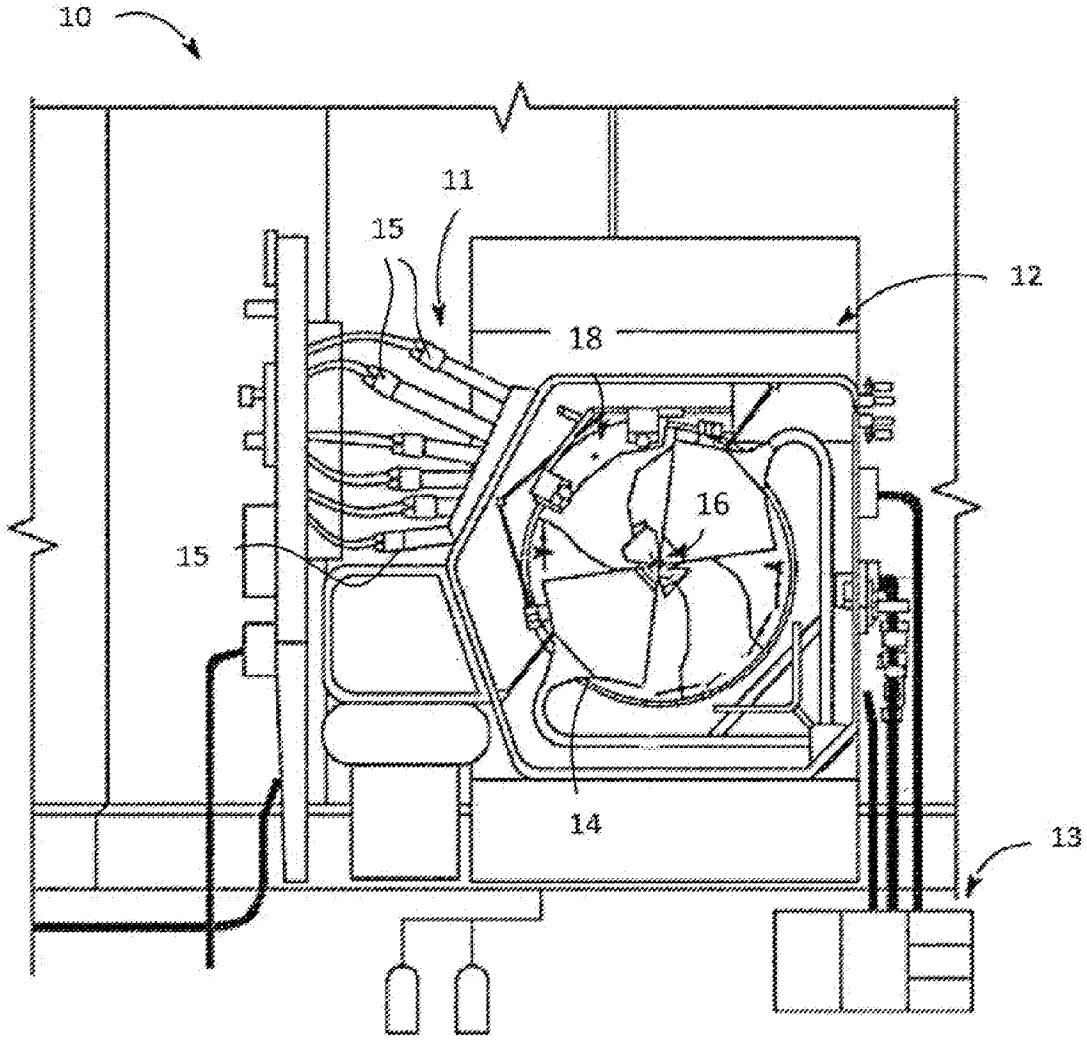
FIGS. 1-2 are schematic representations of an exemplary cyclotron systems which can be employed in connection with the radioisotope production system disclosed herein.

For example, FIG. 1 depicts an exemplary cyclotron construction in which the particle beam is directed by the radioisotope production system 10 through the extraction system 18 along a beam transport path and into the target system 11 so that the particle beam is incident upon the designated target material (solid, liquid or gas). In this exemplary configuration, the target system 11 includes six potential target locations 15, however a greater/lesser number of target locations 15 can be employed as desired. Similarly, the relative angle of each target location 15 relative to the cyclotron body can be varied (e.g. each target location 15 can be angled over a range of 0° ~90° with respect to a horizontal axis in FIG. 2). Additionally, the radioisotope production system 10 and the extraction system 18 can be configured to direct the particle beam along different paths toward the target locations 15.

Figure 2:
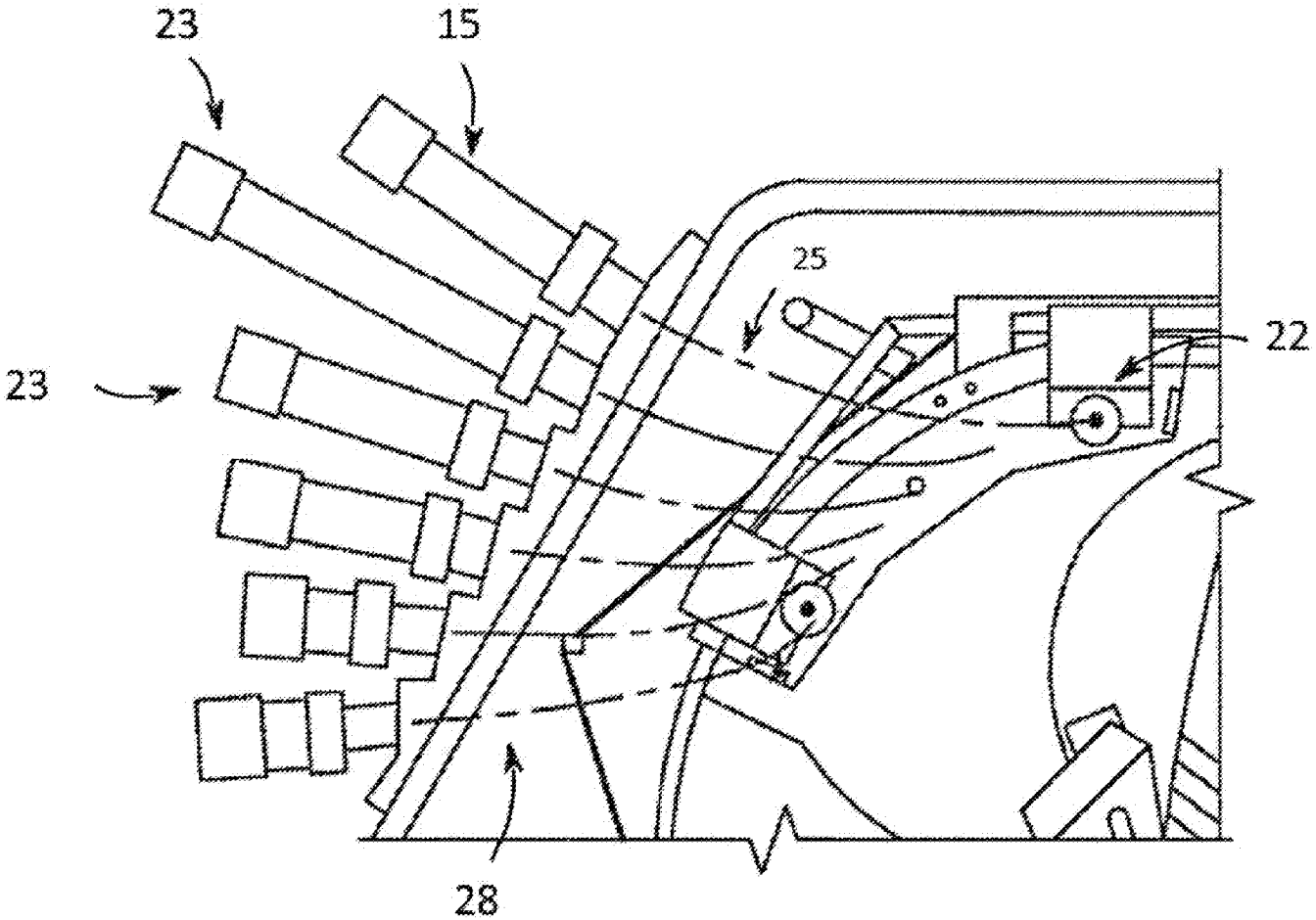

FIG. 2 is a zoom-in side view of the extraction system 18 and the target system 11. In the illustrated embodiment, the extraction system 18 includes first and second extraction units 22. The extraction process can include stripping the electrons of the charged particles (e.g., the accelerated negative charged particles) as the charged particles pass through an extraction foil—where the charge of the particles is changed from a negative charge to a positive charge thereby changing the trajectory of the particles in the magnet field. Extraction foils may be positioned to control a trajectory of an external particle beam 25 that includes the positively-charged particles and may be used to steer the external particle beam 25 toward designated target locations 15. These target locations can include solid, liquid or gas targets.

Embodiments of the present disclosure relate to containers for a small volume of liquid irradiation target materials, systems for, and methods of preparing and containing a target material for irradiation by a charged particle beam from a cyclotron.

Medical cyclotron facilities are used to produce short lived radiotracers such as $^{18}F$, $^{11}C$, $^{15}O$, $^{13}N$ etc. required for Positron Emission Tomography (PET) scans. Suitable pharmaceutical agents are labeled with these radiotracers for use during PET scans to gather information related to the metabolic activity of the cell, which is an important component in modern cancer treatment techniques. PET scans, when used with radiolabeled small molecules that specifically target certain enzymes (e.g., prostate-specific antigen) that may, in certain scenarios, be suggestive of the presence of cancer, can provide information related to the presence of the specific enzyme, thereby providing information to healthcare providers for making a cancer diagnosis.

In general, cyclotrons accelerate charged particles (e.g., hydrogen ions) using a high-frequency alternating voltage. A perpendicular magnetic field causes the charged particles to spiral in a circular path such that the charged particles re-encounter the accelerating voltage many times. The magnetic field maintains these ions in a circular trajectory and a D-shaped electrode assembly creates a varying RF electric field to accelerate the particles. As noted above, the cyclotron further includes a beam extraction system consists of a stripper foil, which changes the ion polarity to positive and directs the positively charged ions to hit a target material contained in a target container according to a target selection setting.

Operation and maintenance of previous target liquid containment units is arduous and requires a substantial amount of time and money to do properly. Given the ballooning costs of healthcare, materials used in medical procedures should be consumed efficiently in a way to minimize the cost to society. Liquid irradiation target materials (e.g., $H_2{}^{18}O$) are expensive to manufacture and residual amounts of the irradiated target material may be present in the target containment device of the cyclotron after irradiation (due to incomplete drainage), thus wasting an expensive resource that could have been put to use, e.g., for additional medical diagnostics/therapies. Current containment devices for irradiation target materials retain material due to the shape of the container not allowing all material to be easily extracted and have volumes that are larger than required to produce the intended radioisotope. Accordingly, a need exists for a containment device and system that provides for a reduction or elimination of waste target material after the target material is irradiated in a cyclotron. Such a device may reduce the costs of operation and maintenance of manufacturing radioisotopes with liquid target materials in a cyclotron by up to 70%.

The irradiation target material may generally be any suitable liquid material as is known in the art. In various embodiments, the irradiation target material may be enriched can include a variety of isotopes, for purpose of illustration and not limitation, some exemplary isotopes include: $^{18}O$-water to produce fluorine-18 ($^{18}F$), and $^{16}O$-water to produce nitrogen-13 ($^{13}N$).

In general, containment devices of the present disclosure for containing a small volume of a liquid irradiation target material include a housing having a chamber. The housing may include any suitable shape as is known in the art (e.g., rectangular box, cube, cylindrical, spherical, disc, or any combination of these) and be designed as a single integral structure, or as multiple components that can be releasably assembled together. The housing may include a top surface that is substantially flat. A chamber may be positioned within the housing having a plurality of walls that define a lip. The chamber is used for containing a liquid target material to be irradiated by a charged particle beam of a cyclotron. In various embodiments, the target material may be copper, silver, cobalt, iron, cadmium, zinc, indium, gallium, lutetium, tellurium, or a metallic salt thereof. The lip may include a substantially flat surface that is recessed from the top surface of the housing. The lip may be parallel to, coplanar, and/or aligned with, the top surface of the housing. Additionally, or alternatively, the lip can be configured as a recessed channel (with adjacent, raised surfaces being coplanar with the top surface of the housing) which extends around or circumscribes the chamber. In various embodiments, the chamber may have a volume of 0.5 mL to 2.5 mL. Preferably, the volume of the chamber is between 0.7 mL and 1.0 mL. In various embodiments, the chamber may have a depth of up to 8 mm.

In various embodiments, the chamber may include a substantially flat base and a wall having a first portion extending therefrom with a first radius of curvature and a second portion extending from the first portion having a second radius of curvature. In various embodiments, the second radius of curvature may be less than the first radius of curvature. In various embodiments, the second radius of curvature may be equal to the first radius of curvature. In various embodiments, the second radius of curvature may be larger than the first radius of curvature. In various embodiments, the first radius of curvature may be convex and the second radius of curvature may be concave. An inflection point, or gradual transition region, can exist between the first and second radius of curvatures. The second portion may define the opening of the chamber.

In various embodiments, the shape of the chamber may generally be a teardrop shape with a flat base. In various embodiments, the shape of the chamber may promote removal/drainage of the liquid in the container after the liquid target material is irradiated by the cyclotron. In various embodiments, the shape of the chamber may promote dispersion of the charged particle beam of the cyclotron to thereby more efficiently and uniformly irradiate the liquid target material.

In various embodiments, the product of irradiating the target material in the cyclotron may be, for example, $^{15}O$, $^{11}C$ gas, liquid $^{18}F$, $^{13}N$, etc. In various embodiments, the charged particle beam energy may be between 8.0 MeV and 17 MeV.

In various embodiments, the containment device may be made out of any suitable metal as is known in the art. For example, the containment device may be made out of niobium, aluminum, titanium, tantalum, tungsten, or any suitable combination of metals (e.g., a metal alloy). In various embodiments, the containment device may include a polymer, for example, polyethylene, polyurethane, polyethylene terephthalate, polyvinyl chloride, etc. In various embodiments, the containment device may be made by machining (e.g., CNC machining), 3D printing (e.g., using Direct Metal Laser Sintering (DMLS) and Fused Deposition Modeling (FDM)), or any suitable manufacturing technique as is known in the art. In various embodiments, one or more components of the devices and systems described herein may be manufactured such that the part(s) have a lower porosity and a higher density. One skilled in the art will recognize that any suitable 3D printing technique may be used to manufacture the components described herein. The containment device disclosed herein can be made from distinct components or fabricated as a single integral piece. In some embodiments, a thickness of the containment device is uniform and depends on the desired level of beam energy applied by the cyclotron. In an exemplary embodiment, the containment device is cooled by a flow of water directed onto the fins of the target body.

In various embodiments, a gasket may be disposed on the surface of the lip. In various embodiments, a foil may contact the gasket to thereby fluidly seal the chamber. In various embodiments, the recessed surface of the lip may have a depth of up to 80% of the thickness of the gasket. In various embodiments, the gasket may extend out beyond the surface of the housing by up to 80% of the thickness of the gasket. In various embodiments, the gasket may be a metal gasket, such as, for example, an aluminum or a Havar alloy gasket. In various embodiments, the foil may be a metal foil, such as, for example, aluminum foil, tantalum foil, titanium foil, Havar (cobalt alloy) foil, or any other suitable metal or metal alloy foil. In various embodiments, the foil may be an isolation foil to thereby isolate the target material from the other components of the system. In various embodiments, the foil may act as a beam degrader to thereby disperse the charged particle beam of the cyclotron before irradiating the target material. The isolation foil can be cooled by gas, e.g. helium, on at least one surface.

The wall(s) of the chamber may include a plurality of apertures, such that a first aperture corresponds to a fluid inlet and a second aperture corresponds to a fluid outlet. The inlet and outlet may be used to supply the liquid irradiate target material to the chamber. In various embodiments, the inlet and outlet may also be used to clean out the chamber after use, for example, by supplying pressurized gas (e.g., air) into the inlet (or outlet) of the first fluid circuit. In various embodiments, the diameter of the pipes of the inlet and outlet may be from 1 mm to 5 mm.

In various embodiments, the containment device may include a heat sink attached to the housing and substantially surrounding the chamber. In various embodiments, the heat sink may include a plurality of parallel, spaced fins that are flat plates. In various embodiments, the heat sink may be made of a metal, e.g., aluminum.

In various embodiments, systems including the devices described herein may include one or more flanges for connecting to a cyclotron, such as a GE PETtrace cyclotron. The flanges may include an orifice aligned with the longitudinal axis for directing the charged particle beam of the cyclotron to the liquid target material in the chamber of the device. For example, the system may further include a front flange, a rear flange, a cooling flange, and/or a connection plate to thereby connect the system to the cyclotron. In various embodiments, the front flange may be configured to connect to the cyclotron and may include a beam aperture for directing the charged particle beam of the cyclotron to the liquid target material inside the chamber. In various embodiments, the cooling flange may include a cooling circuit having a coolant, e.g., liquid helium, flowing there through.

In various embodiments, a method of preparing a liquid target material for irradiation includes providing a device for containing a small volume irradiation target material. In various embodiments, the device includes a housing having a chamber and the housing has a top surface that is substantially flat. The chamber has a substantially flat base and a wall having a first portion extending from the base with a first radius of curvature and a second portion extending from the first portion having a second radius of curvature that is less than the first radius. The chamber also includes an inlet aperture, an outlet aperture, and an opening defining a lip having a second surface that is substantially flat/planar and recessed from the first surface. In various embodiments, the device includes a heat sink including a plurality of parallel fins disposed around the chamber. A gasket is inserted in the lip of the device. The gasket is contacted with a foil thereby fluidly sealing the chamber. The liquid target material is loaded into the chamber of the device.

Figure 3:
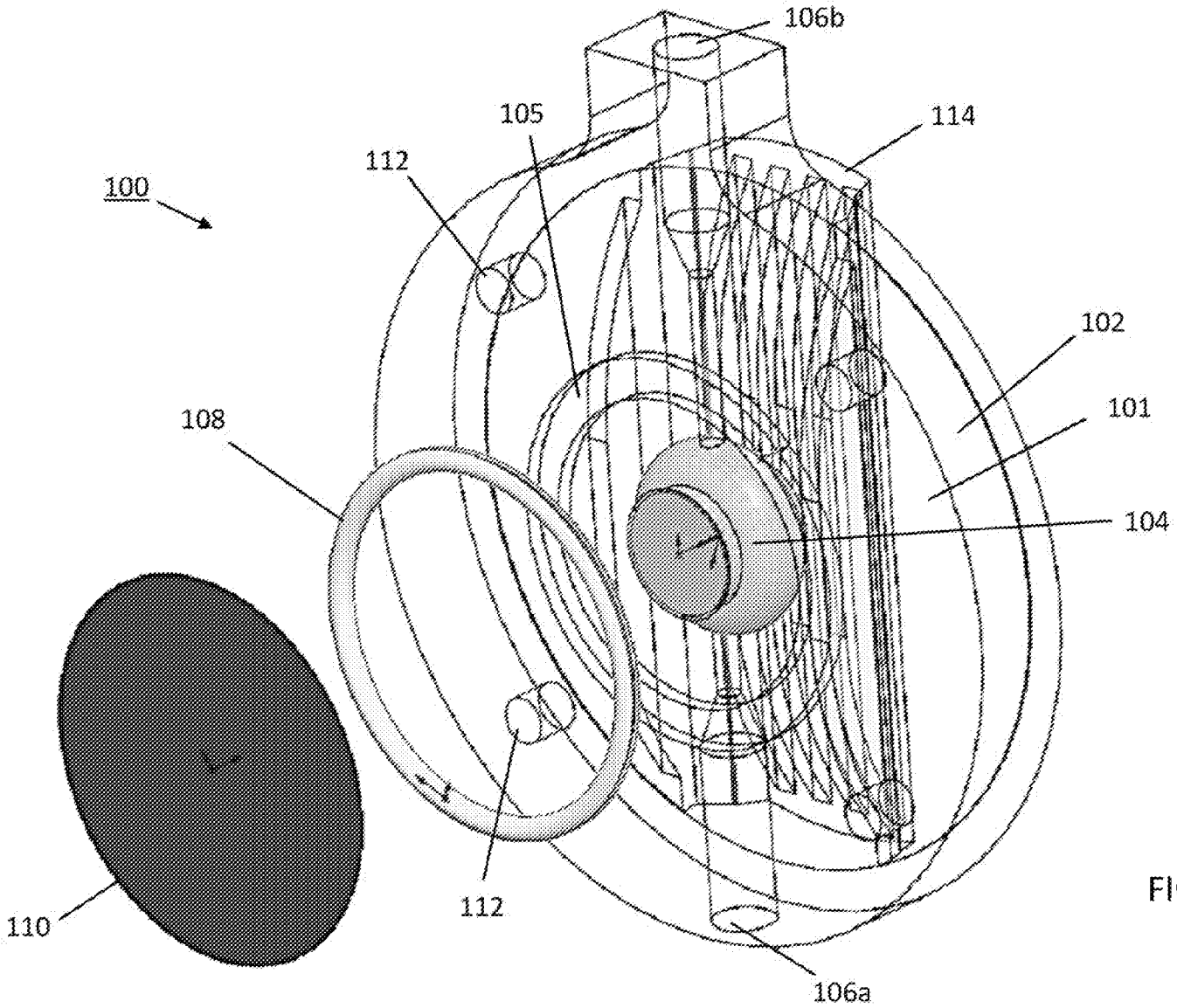
FIG. 3 illustrates an exemplary device for containing a liquid irradiation target material according to embodiments of the present disclosure.

FIG. 3 illustrates an exemplary device 100 for containing a small volume of liquid irradiation target material according to embodiments of the present disclosure. The device 100 includes a cylindrically-shaped, or disc housing 102 having a chamber 104 defining a circular lip 105 around the perimeter of the chamber 104. The chamber 104 can be formed with varying depths, for purpose of illustration and not limitation, an exemplary chamber depth is approximately 8-9 mm. The lip O-ring groove 105 has a substantially flat/planar surface that is recessed from the top surface 101 of the housing 102 by about 1 mm to about 1.2 mm. The chamber 104 generally includes a flat-bottomed teardrop shape described in more detail with respect to FIGS. 5A and 5B. The top surface 101 of the housing 102 and the surface of the lip 105 may be coplanar, i.e., parallel to one another and aligned with one another in the same X-Y plane (where Z is the height). The chamber 104 further includes apertures for a fluid inlet 106*a* and a fluid outlet 106*b*. In some embodiments, the apertures for fluid inlet/outlet 106*a*, 106*b* are aligned longitudinally (e.g. diametrically opposed from each other). The fluid inlet/outlet 106*a*, 106*b* can have a first conduit portion, proximate the chamber 104, which has a smaller diameter than the second conduit portion, proximate the edges of the housing 102.

In use, a gasket 108 is placed against the recessed surface of the lip 105 and a foil 110 contacts the gasket 108 to thereby fluidly seal the chamber 104. The foil 110 may be, for example, a Havar alloy foil, Ti, Ta, Al, Ag. Also, the gasket 108 can be formed from EPDM, Viton, Silicon, Ag, and/or Ni and other suitable metals. In some embodiments, the gasket 108 has a height (or thickness) such that approximately 60% sits within the groove 105, while the remaining 40% extends above the surface 101 for compression to seal adjacent surfaces.

The housing 102 further includes alignment holes 112 into which alignment pins (not shown) may be placed to align the housing 102 with additional components (e.g., front/rear flanges). The alignment holes/pins ensure that the chamber 104 is properly aligned with the irradiating beam. Additionally, the pins can be removable to allow the housing 102 to be removed and replaced as well as retro-fitted with existing cyclotrons.

The housing 102 further includes a heat sink 114 disposed at the bottom/rear of the housing 102. The heat sink 114 substantially surrounds the chamber 104 to thereby draw heat generated by the irradiation process away from the liquid target material inside the chamber 104. The heat sink 114 includes a set of equally-spaced, parallel fins and may be configured to interface with (and directly contact) a cooling flange that receives a coolant liquid/gas (e.g., liquid helium). The dashed arrows "A" in FIG. 4 depict an exemplary coolant fluid flow path across the heat sink 214.

Figure 4:
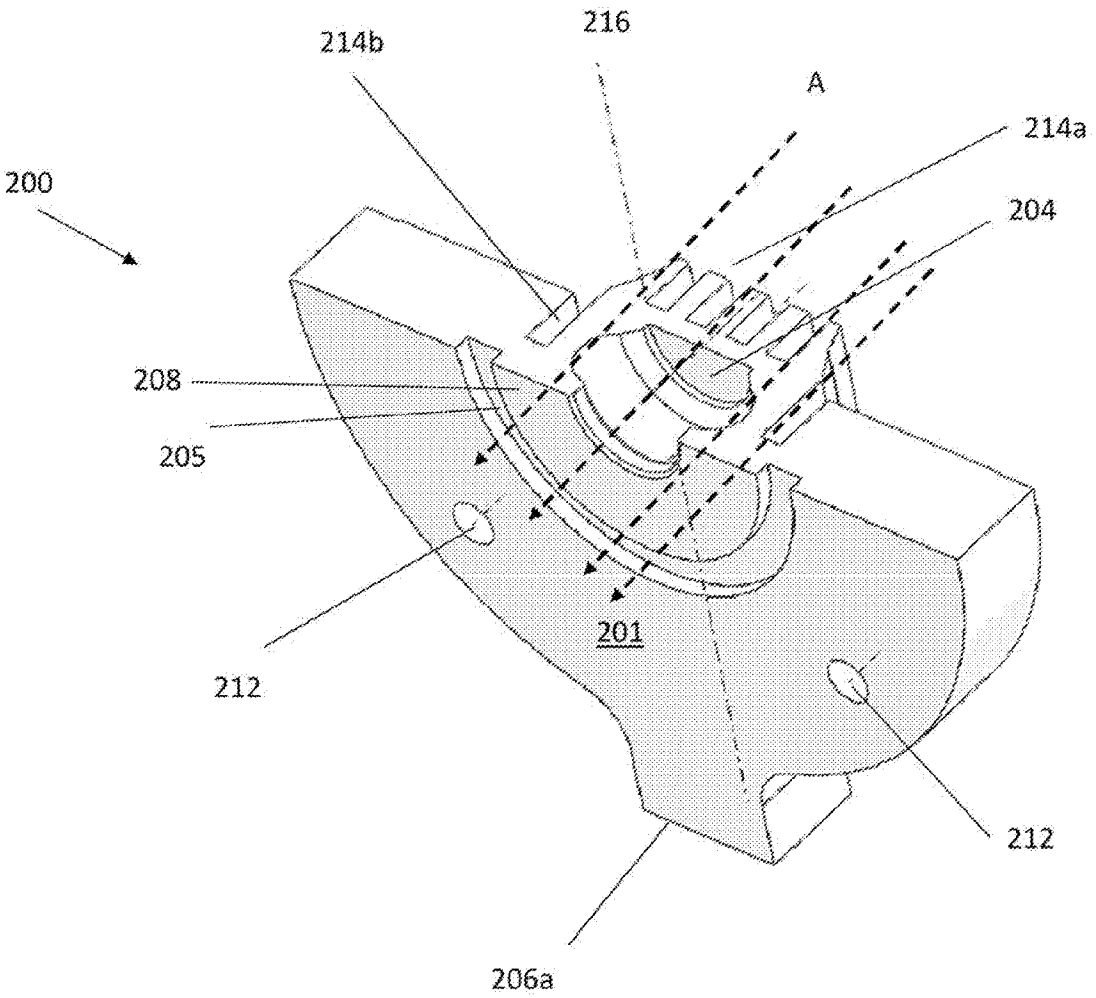
FIG. 4 illustrates a cross-sectional view of an exemplary device for containing a liquid irradiation target material according to embodiments of the present disclosure.

FIG. 4 illustrates a cross-sectional view of an exemplary device 200 for containing a liquid irradiation target material according to embodiments of the present disclosure. The device 200 illustrated in FIG. 4 may be substantially similar to the device 100 of FIG. 3 and includes a housing 202 having a chamber 204, a lip 205, an inlet 206*a*, an outlet (not shown), alignment holes 212, and a heat sink 214. The lip 205 can be formed as a recess or channel sunken with respect to the top surface 201 of the container. The lip 205 can be formed with a larger radius than the mouth, or any other portion of chamber 204. The lip can be defined and bordered by two adjacent top surfaces of the housing 201, 208 such that surfaces 201 and 208 are coplanar, with lip 205 recessed therebetween. As shown in FIG. 4, the device 200 includes a longitudinal axis 216 along the axis of the inlet 206*a* and outlet. In the exemplary embodiment shown, the heat sink 214 includes a fins 214*a* of a first, shorter, length which extend from the back surface of the chamber 204 to a location below/behind the back surface of the container, and a second fin 214*b* of a longer length which extend from a location proximate the top/front surface 201 to the same end point of fins 214*a*. As shown, fin 214*b* can be disposed immediately adjacent and circumscribe the chamber 214. Thus, an air gap can be formed surrounding the external wall of the chamber 204. This fin configuration allows for rapid heat transfer via conduction both longitudinally and radially from the chamber 204. Fins 214*b* can have a different geometry than fins 214*a*, e.g., fins 214*b* can have a chamfered or tapered end.

Figure 5A:
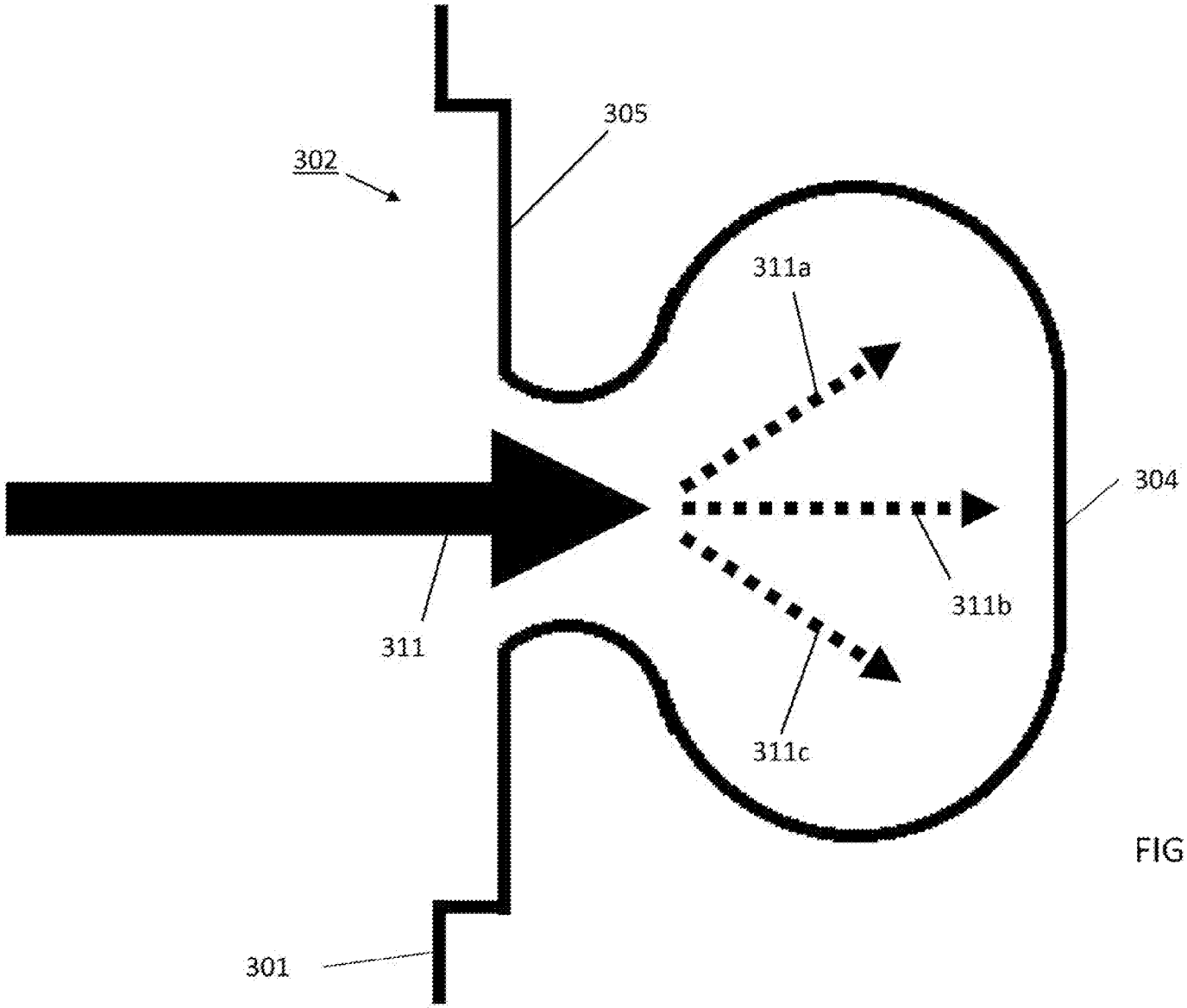
FIGS. 5A, 5B and 6 illustrate a side profile of a chamber for containing a liquid irradiation target material according to embodiments of the present disclosure.
Figure 5B:
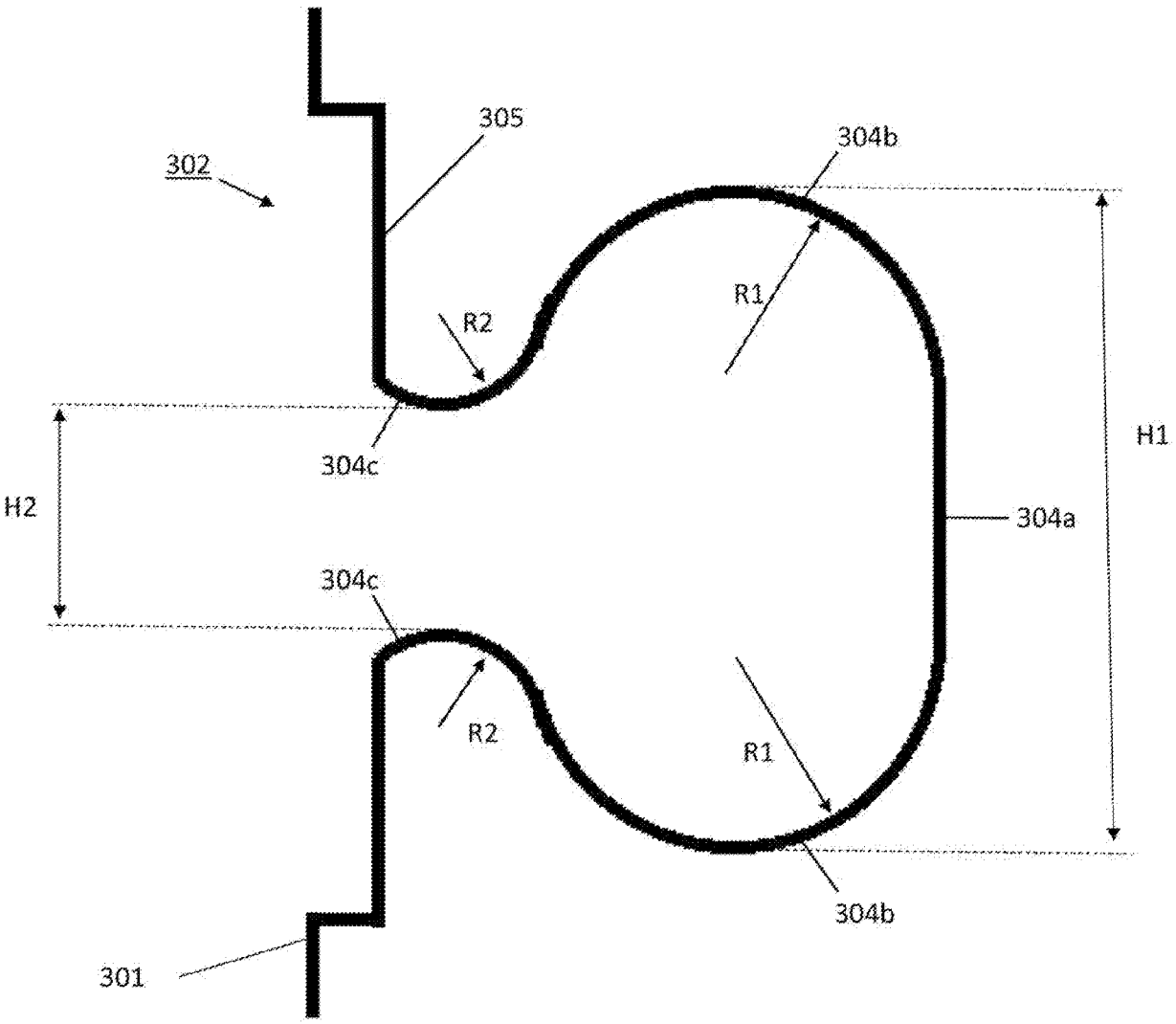

FIGS. 5A and 5B illustrate a side profile of a chamber 304 for containing a liquid irradiation target material according to embodiments of the present disclosure. As illustrated in FIGS. 5A and 3B, the chamber 304 includes a lip 305 around the perimeter of an opening into which a charged particle beam 311 from a cyclotron is directed to thereby irradiate the liquid irradiation target material. The beam 311 enters the chamber 304 at approximately a 90° angle from the longitudinal axis of the chamber 304. As shown in FIG. 5A, the chamber 304 is shaped in such a way to optimize dispersion of the beam 311 into separate beam components 311*a*, 311*b*, and 311*c* to evenly irradiate the liquid target material contained within the chamber 304. The shape of the chamber may also facilitate removal of the liquid target after irradiation as the liquid target materials generally are costly to produce and thus should be used efficiently with minimal waste.

Figure 6:
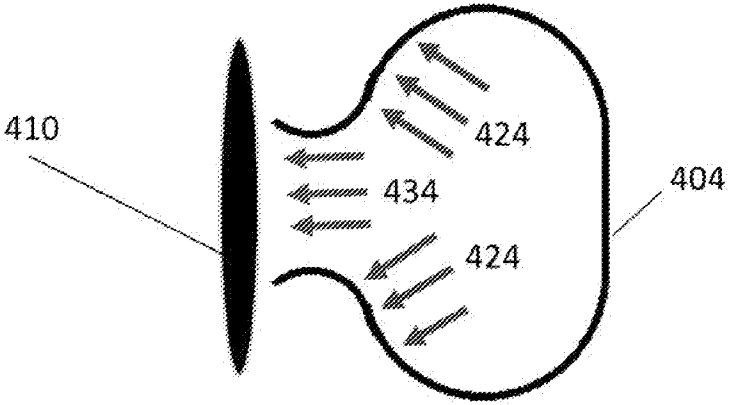

In accordance with an aspect of the disclosure, the beam dispersion on the container disclosed herein reduces the amount of metal particles produced by the target body flaking off when the beam comes into contact with the interior chamber walls 104. Additionally, as shown in FIG. 6, the pressure generated within the chamber 404 by the beam passing through foil 410 into the water contained in the chamber 404 is retained and directed, as shown by arrows 424 in FIG. 6, on portions of the interior walls proximate the chamber opening. This reduces the force, as shown by arrows 434, acting to bulge the foil 410 outward in the opposite direction of the beam. The smaller the opening of the chamber 404, the less pressure is exerted on the foil 410. Advantageously, this allows for the target container disclosed herein to handle higher current applications, as well as preventing foil 410 rupturing. For purpose of illustration and not limitation, an exemplary embodiment of the present disclosure provides a target buildup pressure of approximately 400~700 psi, with the majority of this pressure retained by the chamber walls rather than the foil 410.

As shown in FIG. 5B, the chamber 304 includes a substantially flat base 304*a* followed by curved portions 304*b* having a radius of curvature R1. Curved portions 304*c* follow curved portions 304*b* and have a radius of curvature R2 that is smaller than R1. The curved portions 304*c* extend to, and create, the opening of the chamber 304. In various embodiments, the curved portions 304*b* and curved portions 304*c* may include the same radius of curvature such that R1 equals R2. In various embodiments, the curved portions 304*b* may include a radius of curvature R1 that is less than the radius of curvature R2. For purpose of illustration and not limitation, an exemplary embodiment of the present disclosure has: a radius R2 of approximately 0.2~2.5 mm; approximately a 12.5 mm diameter chamber 304 (i.e. between sidewalls); and a radius R1 of approximately 0.2~1 mm. Also, an inflection point, or gradual transition region, can exist between the first and second radii.

Accordingly, the sidewall(s) defining the chamber 304 are non-linear and continuously curved. In the embodiment shown, the side walls 304*b*, 304*c* include a concave portion 304*b* and a convex portion 304*c* (relative to the interior of the chamber) such that they include a gradual or blended inflection point transitioning between these concave/convex curves. As shown, the concave portion 304*b* can extend a greater length than the convex portion 304*c*. Thus the chamber 304 can have a first height H1 (e.g., approximately 12.5 mm0 proximate the flat back wall 304*a*, which is greater than a second height H2 proximate the mouth formed at the interface of sidewalls 304*c* and lip 305. In accordance with an aspect of the disclosure, the contours of the chamber 304 are continuously curved. As such, there are no sharp or abrupt corners which can cause some residual irradiated material to adhere (e.g. via capillary forces) to the walls, thus undesirably reducing yield, as well as presenting potential hazard for exposure.

In some embodiments, as shown in FIG. 4, the chamber 214 wall can transition from a flat bottom/rear surface to an initially convex wall, which then transitions to a concave wall, which then again transitions to a convex wall proximate the mouth/opening of the chamber. The concave portion of the contour can extend over the majority of the chamber wall surface, e.g. 70% of the total chamber wall height.

Figure 7:
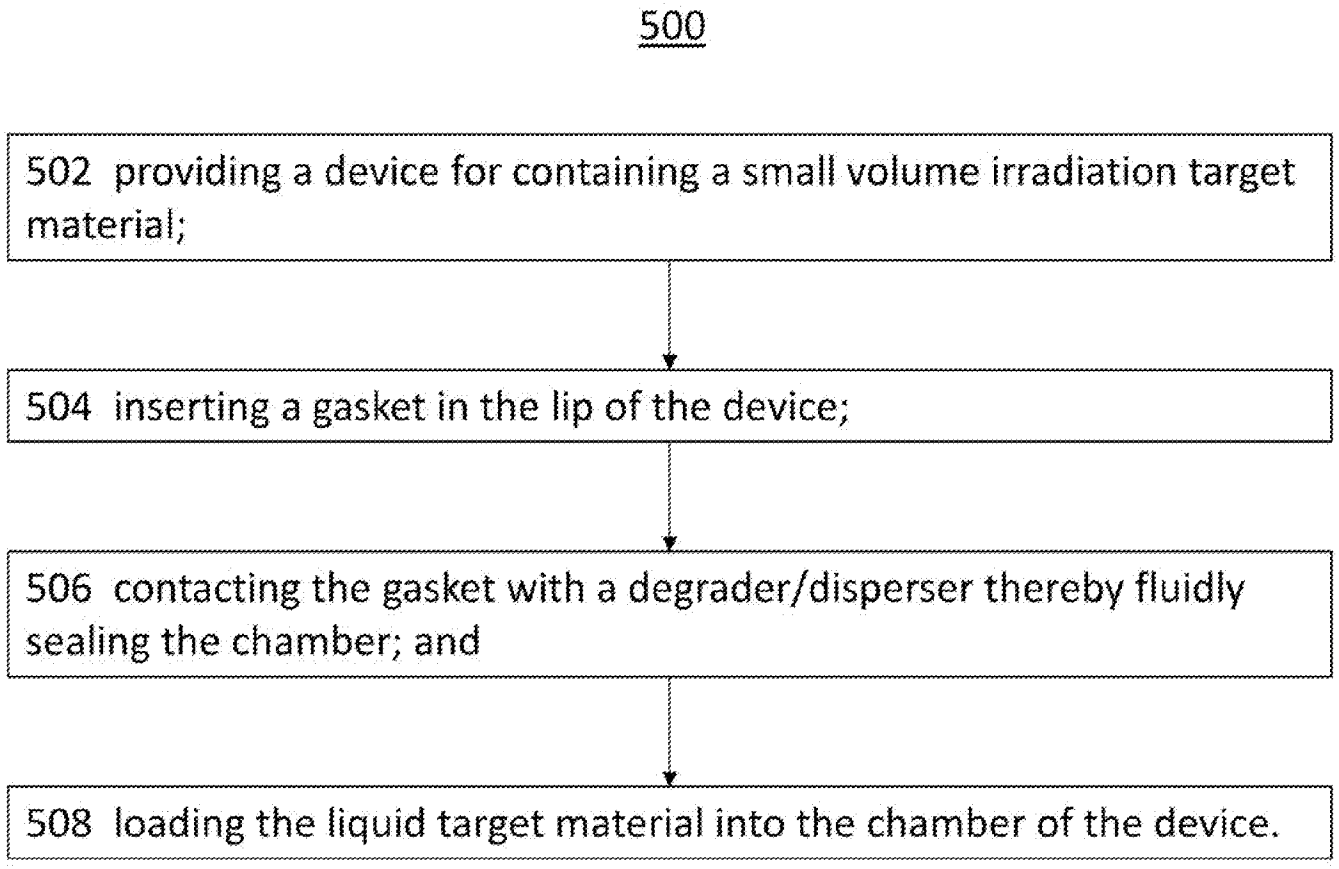
FIG. 7 illustrates a method of preparing a liquid target material for irradiation according to embodiments of the present disclosure.

FIG. 7 illustrates a method 500 of preparing a liquid target material for irradiation according to embodiments of the present disclosure. The device is positioned within a target extraction unit 15, as shown in FIGS. 1-2. At 402, a device is provided for containing a small volume irradiation target material. In various embodiments, the device includes a housing having a chamber and the housing has a top surface that is substantially flat. The chamber has a substantially flat base and a wall having a first portion extending from the base with a first radius of curvature and a second portion extending from the first portion having a second radius of curvature that is less than the first radius. The chamber also includes an inlet aperture, an outlet aperture, and an opening defining a lip having a second surface that is substantially flat and recessed from the first surface. In various embodiments, the device includes a heat sink including a plurality of parallel fins disposed around the chamber.

At 504, a gasket is inserted in the lip of the device. At 506, the gasket is contacted with a foil thereby fluidly sealing the chamber. At 508, the liquid target material is loaded into the chamber of the device. For example, the target can be delivered with irradiable fluid from the source into to the target chamber 104 via input conduit (which can include a valve) 106*a*. In some instances, the irradiable fluid within the chamber is pressurized prior to being irradiated. Next, the cyclotron can generate, continuously or intermittently, a beam of protons (e.g., H+) which are directed at the target. In an exemplary operation, when the fluid in the target chamber is irradiated with the beam of protons, O18 is transmuted to F18, O16 is transmuted to N13, or O16 is transmitted to O15, depending on the particular irradiable fluid chosen.

In various embodiments, the liquid target material is provided in a volume of about 0.7 mL to about 1.0 mL. In various embodiments, the liquid target material may be irradiated through the beam degrader/disperser, e.g. foil. The irradiated target material may be removed from the chamber via an outlet. The irradiated degrader/disperser, e.g. foil, may be disposed of.

The descriptions of the various embodiments of the present invention have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

What is claimed is:

1. A device for containing a liquid irradiation target material, the device comprising:

a housing comprising a chamber, the housing having a first surface that is flat, an inlet aperture, an outlet aperture, and a lip having a second surface that is flat and recessed from the first surface;

the chamber having a flat base perpendicular to a central axis of the chamber and a wall having a first portion extending from the base, the first portion being concave with respect to the central axis and having a first radius of curvature, and a second portion extending from the first portion, the second portion being convex with respect to the central axis and having a second radius of curvature, wherein the second radius of curvature is less than the first radius of curvature;

a heat sink comprising a plurality of fins disposed at least partially around the chamber.

2. The device of claim 1, wherein the first radius of curvature is between 0.2 mm to 1 mm.

3. The device of claim 1, wherein the second radius of curvature is between 2 mm to 3 mm.

4. The device of claim 1, wherein the chamber has a depth of 7 mm.

5. The device of claim 1, wherein the chamber has a volume of 0.5 mL to 2.5 mL.

6. The device of claim 5, wherein the chamber has a volume of 0.7 mL to 1.0 mL.

7. The device of claim 1, wherein the plurality of fins comprises parallel plates.

8. The device of claim 1, wherein the housing comprises a metal.

9. The device of claim 8, wherein the metal is selected from the group consisting of: Aluminum and Niobium.

10. The device of claim 1, wherein the device is an integral unit.

11. The device of claim 1, wherein the housing comprises a cylindrical shape.

12. The device of claim 1, further comprising a gasket disposed at least partially within the lip.

13. The device of claim 12, wherein the gasket comprises a metal.

14. The device of claim 13, wherein the metal is selected from the group consisting of: Havar alloy and aluminum.

15. A method of preparing a liquid target material for irradiation, the method comprising:

providing the device of claim 1;

inserting a gasket at least partially in the lip of the device;

contacting the gasket with a foil thereby fluidly sealing the chamber; and loading the liquid target material into the chamber of the device.

16. The method of claim 15, wherein the liquid target material is provided in a volume of 0.7 mL to 1.0 mL.

17. The method of claim 16, further comprising:

irradiating the liquid target material through the foil;

removing the irradiated liquid target; and disposing of the irradiated foil.

18. The method of claim 15, wherein the foil comprises a metal selected from the group consisting of: Havar alloy and aluminum.

* * * * *